United States Patent [19]

Kobayashi et al.

[11] Patent Number: 4,759,648

[45] Date of Patent: Jul. 26, 1988

[54] PRINTING DEVICE FOR A WELL-ALIGNED PRINTING LINE

[75] Inventors: Masanari Kobayashi, Ichinomiya; Shinken Ozeki, Nagoya, both of Japan

[73] Assignee: Brother Kogyo Kabushiki Kaisha, Aichi, Japan

[21] Appl. No.: 878,331

[22] Filed: Jun. 25, 1986

[30] Foreign Application Priority Data

Jul. 1, 1985 [JP] Japan ..... 60-144164

[51] Int. Cl.[4] ..... B41J 19/92

[52] U.S. Cl. ..... 400/568; 400/54

[58] Field of Search ..... 400/54, 74, 569, 902

[56] References Cited

U.S. PATENT DOCUMENTS

| | | | |
|---|---|---|---|
| 4,389,129 | 6/1983 | Sugiura | 400/54 |
| 4,398,837 | 8/1983 | Torii et al. | 400/74 |

FOREIGN PATENT DOCUMENTS

| | | | |
|---|---|---|---|
| 14074 | 1/1982 | Japan | 400/54 |
| 51173 | 3/1983 | Japan | 400/54 |
| 71185 | 4/1983 | Japan | 400/54 |
| 179678 | 10/1983 | Japan | 400/54 |
| 33167 | 2/1984 | Japan | 400/568 |
| 124881 | 7/1984 | Japan | 400/54 |

*Primary Examiner*—David Wiecking

*Attorney, Agent, or Firm*—Parkhurst & Oliff

[57] ABSTRACT

A printing device with an improved printing quality is proposed. A printed line never becomes rugged even when the cover of the printing mechanism is operated during the printing. The printing device includes a sheet feed means including a feed motor, a movable cover for covering a printing mechanism, a detector for detecting an opening a last position of the feed motor at a time when the opening of the cover is detected, and a feed control means for setting the feed motor at the last phase position when the closing of the cover is detected.

12 Claims, 11 Drawing Sheets

PRINTING DEVICE FOR A WELL-ALIGNED PRINTING LINE

BACKGROUND OF THE INVENTION

1. Technical Field

The present invention relates to a printing device installed in an electronic typewriter or a printer.

2. Prior Art

Generally, a printer with an ink ribbon and a carriage, or one further including a type wheel or a type ball is equipped with a cover for its printing mechanism which can be opened and closed so that the ink ribbon, type wheel or type ball are exchanged easily. However, it might occur that the carriage is moved by a touch of an operator's hand, or a type on the printing position is changed after exchanging the type wheel or type ball with the cover opened. Therefore, resuming to print after closing the cover might cause a shift of the printing position or print of a character which is different from desired one. To solve the aforementioned problem, a carriage is made to return to a predetermined position such as a home position, and a predetermined type of the type wheel or the type ball is set to a printing position after the cover is closed. Such routines are executed just after the power is on, by transmitting a reset signal to the reset terminal of an electronic control unit (hereinafter referred to ECU) for controlling the printing mechanism. After these initializations, a normal printing can be resumed.

SUMMARY OF THE INVENTION

In the above printing device, the ECU usually controls not only a sheet feed motor but also at least one of motors for operating the printing mechanism so as to reduce the number of parts, to decrease the cost and to shrink the body. As mentioned above, the ECU is reset to an initialized state in accordance with opening of the cover, resulting that the sheet feed motor is initialized along with the motor for the printing mechanism. When printing is resumed after closing the cover, the feed motor starts from a preset initial exciting phase in accordance with the reset of the ECU, which provides a possibility that the exciting phase of the feed motor just before opening of the cover is not coincident with that at the resuming of feeding after closing the cover. Such a discrepancy results in a disarraying of printed characters in a line before and after the cover is opened and closed.

The object of the present invention is to provide an improved printing device in which the first exciting phase of the feed motor after closing the cover is made to be coincident with that of just before opening, in order to eliminate such a possibility of a disarray in a printed line and make printing with quality.

In order to solve this and other objects, a printing device according to this invention includes a sheet feed means including a feed motor, a movable cover for covering a printing mechanism, a detector for detecting an opening and a closing of the cover, a memory means for storing a last position of the feed motor at a time when the opening of the cover is detected, and a feed control means for setting the feed motor at the last position when the closing of the cover is detected.

When the cover for the printing mechanism is opened in printing, a single ECU for controlling both at least one of the motors for the printing mechanism and the feed motor is initialized, as just after the power is on.

The feed control means stores the exciting phase of the feed motor just before opening of the cover in the memory means prior to the initialization of the ECU. When a feeding is performed based on a printing command or a carriage return command after closing the cover, the feed control means controls the feed motor to be excited from the exciting phase stored in the memory means. Although the ECU is initialized in response to opening of the cover, feeding is resumed by exciting the feed motor from the exciting phase of just before opening of the cover, which prevents the sheet from being shifted and provides printing with quality.

DETAILED DESCRIPTION OF PREFERRED EMBODIMENT

A preferred embodiment of the present invention will be described with reference to an electronic typewriter with a type wheel.

Figure 1:
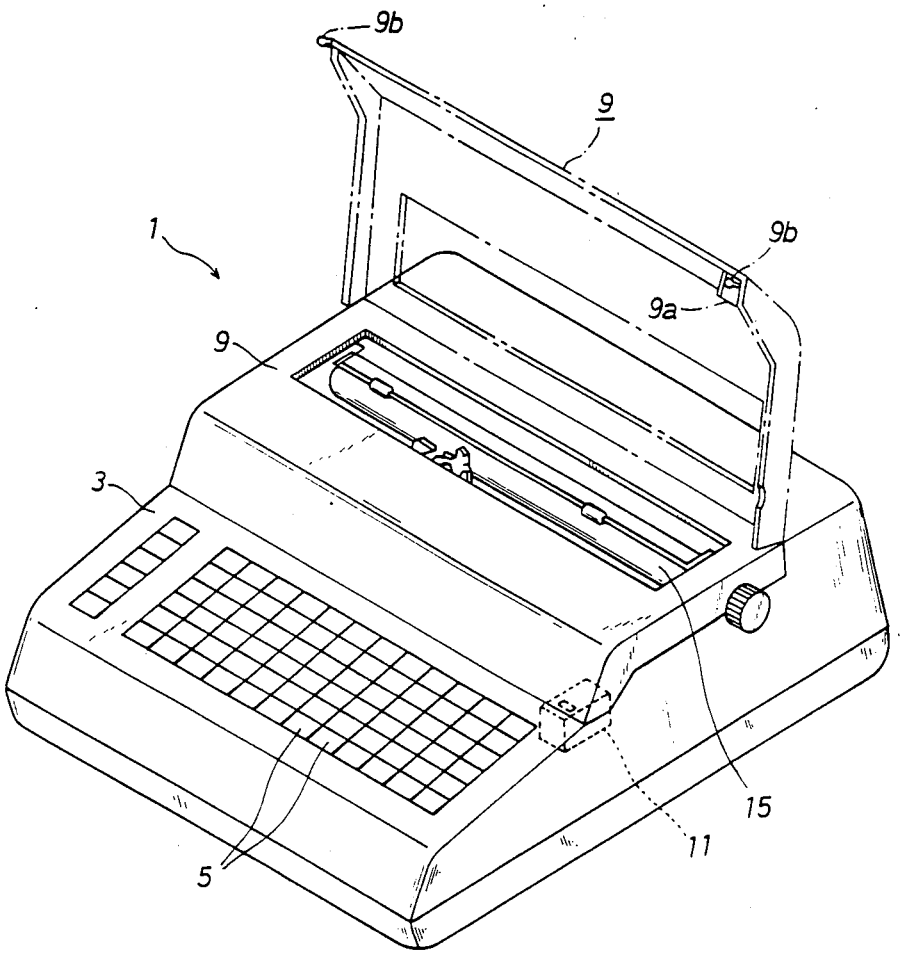
FIG. 1 is a perspective view of an electronic typewriter according to the present invention.
Figure 2:
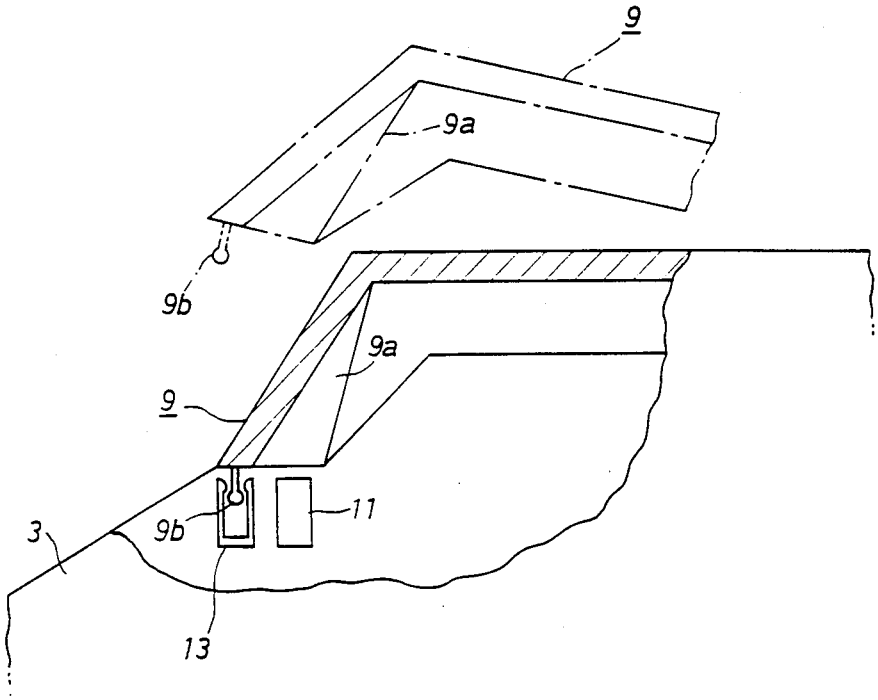
FIG. 2 is a sectional view illustrating a mechanism for detecting the opening and closing of the cover.

Referring now to FIG. 1 illustrating an electronic typewriter including a printing device according to the present invention and FIG. 2 illustrating a mechanism for detecting opening and closing of the cover, plural keys 5 are arranged in the upper front of a body case 3 of an electronic typewriter 1. A printing mechanism 7, to be described later, is installed in the central opening of the body case 3. A cover 9 is installed on the body case 3 to rotate around its rear end and to open and close the opening of the body case 3. A rib 9*a* constituting a part of the mechanism for detecting opening and closing of the cover is integrally formed at the right front side of the cover 9 as shown in FIG. 1. A protrusion 9*b* with an enlarged end is also integrally formed in the front ends of the cover 9. A microswitch 11 constituting a part of the mechanism for detecting opening and closing is installed responsive to the rib 9*a* in the body case 3. The microswitch 11 is turned OFF in case the depression by the rib 9*a* is released in accordance with opening of the cover 9. A receptor 13 is installed responsive to the protrusion 9*b* in the body case 3. The protrusion 9*b* is engaged to the receptor 13 when the cover 9 is closed.

Figure 3:
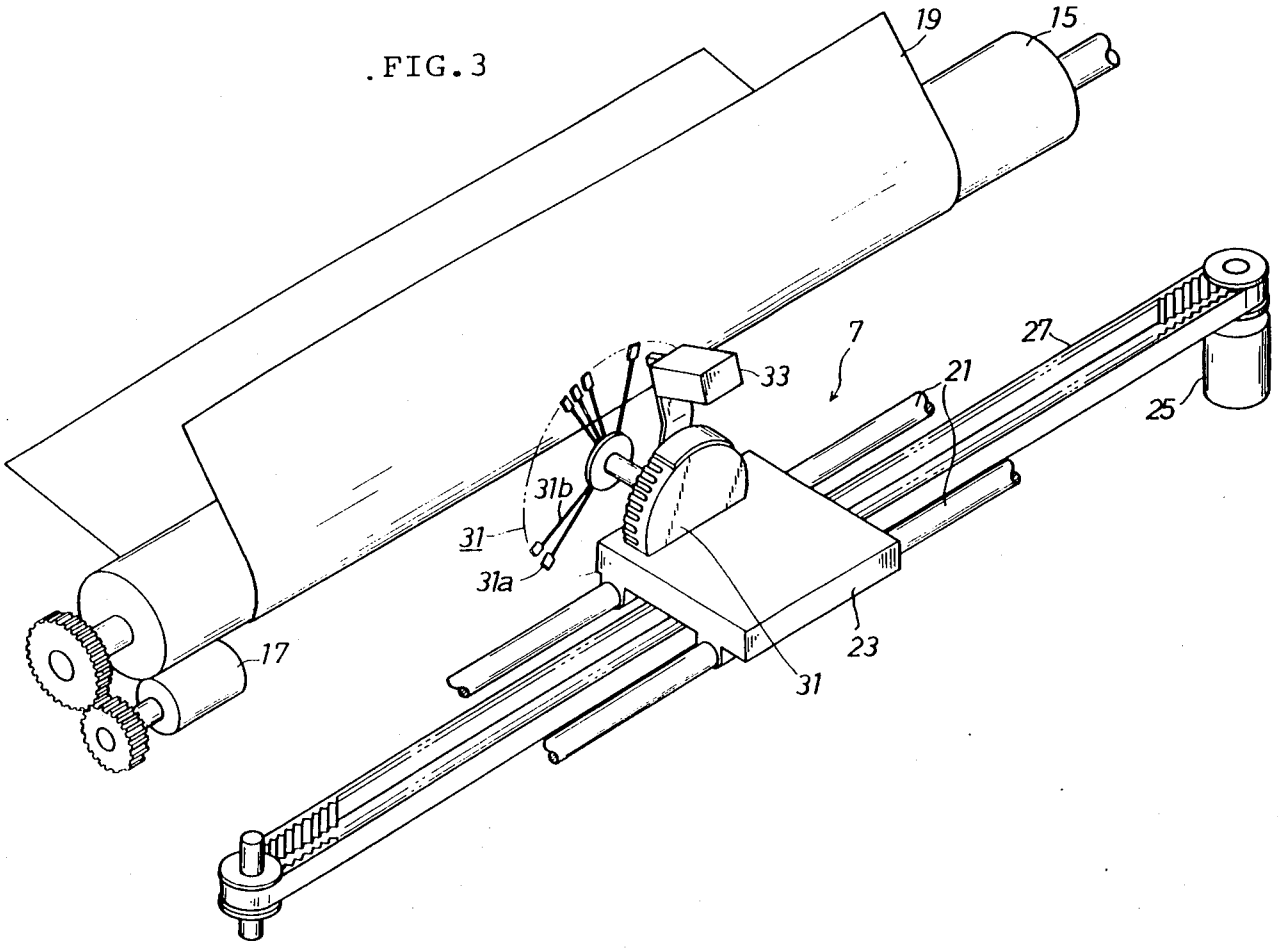
FIG. 3 is a perspective view illustrating a printing mechanism.

In FIG. 3 illustrating the feeding and the printing mechanism, a platen 15 is movably held between bilateral frames (not shown) in the electronic typewriter 1, and is connected to a sheet feed motor 17, which is made of, for example, a step motor with 2—2 exciting phases. A sheet 19 set on the platen 15 is fed in predetermined direction in accordance with driving the feed motor 17. The printing mechanism 7 has a carriage 23 on which a type wheel 31, a print hammer 33 and a ribbon cassette (not shown) are mounted. A pair of carriage guides 21 are installed between the bilateral frames in parallel with the axis of the platen 15. On the carriage guides 21, the carriage 23 is slidably held. A carriage drive motor 25, one of the motors for the printing mechanism, is connected via a timing belt 27 to the carriage 23. The carriage 23 is driven horizontally along the printing line by the carriage drive motor 25. A select motor 29, one of the motors for the printing mechanism, is installed on the carriage 23 and connected to the type wheel 31. In the type wheel 31, each of plural types 31*a* is attached on each tip of radial spokes 31*b*. The type wheel 31 is rotated by the type select motor 29 so that a desired type 31*a* is set to the printing position. A print hammer 33 hits the selected type 31*a* rotated to the printing position on the sheet 19 via a type ribbon of the ribbon cassette with a predetermined impact force depending on the type face area of the type 31*a*. In this manner, a desired character is printed on the sheet 19. In the carriage 23, a ribbon lift motor 30, which is one of the motors for the printing mechanism, is installed. A ribbon guide (not shown) is installed in connection to the rotating axis of the ribbon lift motor 30 so as to be able to move vertically at the printing position. On the carriage 23, the ribbon cassette (not shown) is removably held. The type ribbon (not shown) is folded and accommodated in the ribbon cassette, in which a feed roller and an idle roller (both not shown) are rotatably held and pressed in contact with each other. The feed roller is connected to a ribbon feed motor 32 which is one of the motors for the point mechanism and is mounted on the carriage 23. The type ribbon is pulled out from one extended arm (not shown) of the ribbon cassette and is pulled into the other extended arm (not shown) through the feed roller and the idle roller in accordance with driving the ribbon feed motor 32. The type ribbon stretched between the extended arms is held by the ribbon guide to be orderly located on the printing position and is moved up and down by the ribbon lift motor 30 in accordance with a strike of a type 31*a*. Every motor for the print mechanism is a step motor.

Figure 4A:
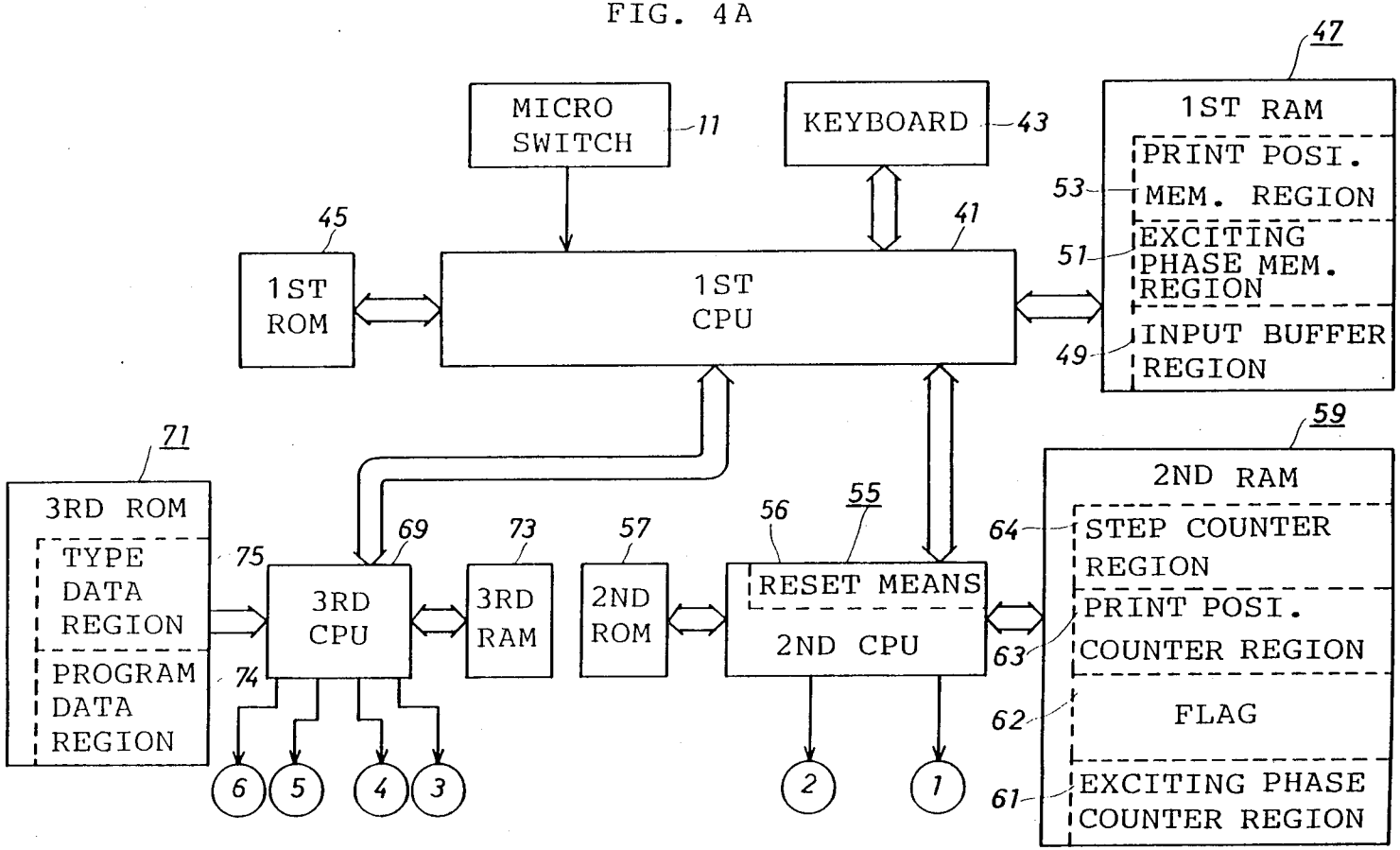
FIGS. 4A, 4B and 4C are block diagrams showing an electronic construction of the electronic typewriter.
Figure 4B:
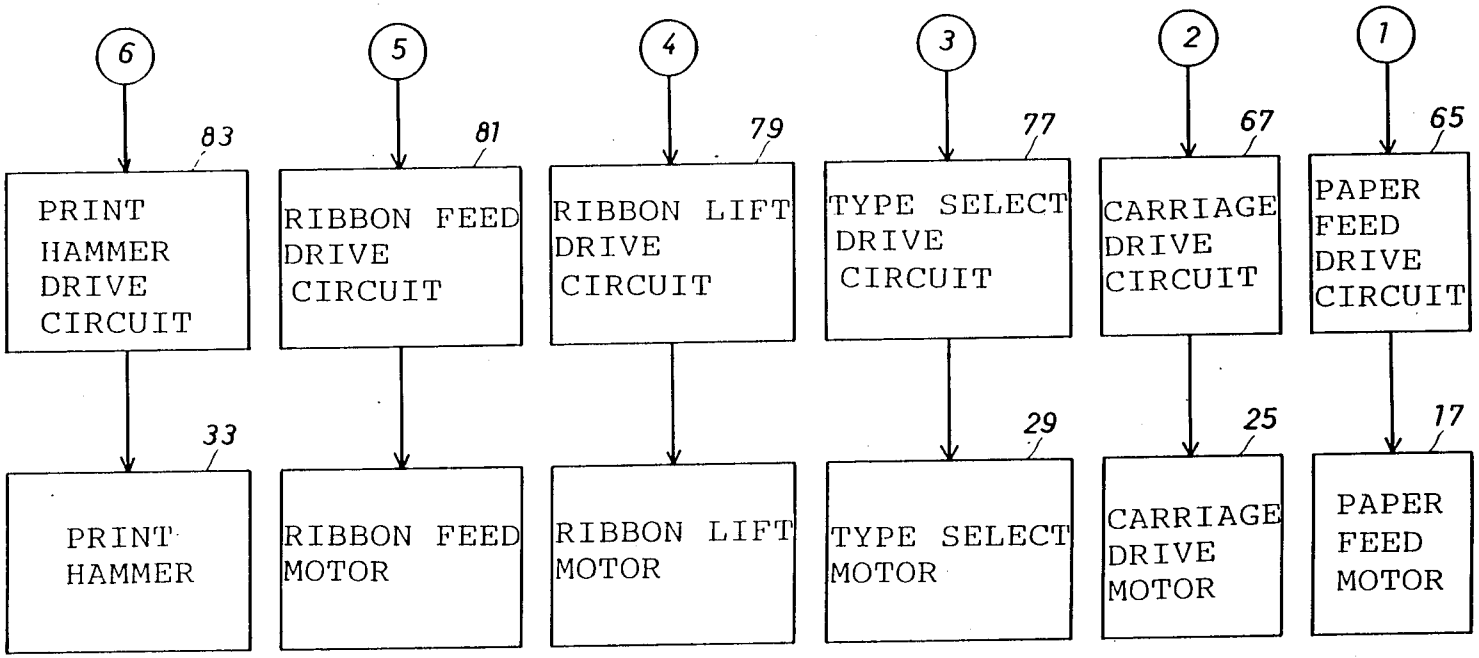

In FIGS. 4A and 4B showing controlling the above constructed electronic typewriter 1, a first CPU (central processing unit) 41 constituting a feed control means is connected to a keyboard 43 from which various type data and control data corresponding to each key 5 are inputted responsive to the depression of the key 5. The first CPU 41 is connected to a microswitch 11 whose ON or OFF responds to the opening or closing of the cover 9. The first CPU 41 is also connected to a first RAM (random access memory) 47 and a first ROM (read only memory) 45. In the ROM 45, a program data is previously stored. The first RAM 47 comprises an input buffer region 49, an exciting phase memory region 51 and a printing position memory region 53. In the input buffer region 49, a line of type data and control data inputted from the keyboard 43 are to be stored. In the exciting phase memory region 51, exciting phase data of the feed motor 17 just before opening of the cover is to be stored. In the printing position memory region 53, printing position data of the printing mechanism 7 just before opening of the cover 9 is stored. The first CPU 41 generates various control data such as rotational step number data and rotational direction data for the feed motor 17 based on the key operation on the keyboard 43 and outputs control data to a second CPU 55 and a third CPU 69, which are described later.

The first CPU 41 is connected to the second CPU 55 which constitutes an ECU (electronic control unit) for executing drive control for the feed motor 17 and the carriage drive motor 25 that is one of the motors for the printing mechanism. A second ROM 57 and a second RAM 59 are respectively connected to the second CPU 55. In the second ROM 57, program data for executing an initial setting, which is described later, is previously stored. The second RAM 59 comprises an exciting phase counter region 61 for controlling the feed motor 17, a flag 62, a step counter region 64, a printing position counter region 63 for controlling the carriage drive motor 25 and other various regions. The exciting phase counter region 61 is successively incremented or decremented in accordance with one turn of the exciting phase of the feed motor 17 driven by an output signal of the second CPU 55. Thus, the current exciting phase of the feed motor 17 is always stored in the exciting phase counter region 61. In the flag 62, the rotational direction of the feed motor 17 is stored based on the feed data inputted from the first CPU 41. In the step counter region 64, a step number for which the feed motor 17 is to be rotated is stored based on the feed data inputted from the first CPU 41. The above step number is successively incremented or decremented responsive to commanded exciting target data and an executed step number, so that the step number keeps an unexecuted rotating step number which is a remaining step number still to be executed. The printing position counter region 63 is successively incremented or decremented in accordance with the turning of the exciting phase of the carriage drive motor 25 so as to store the current printing position of the printing mechanism 7. The second CPU 55 also acts as a reset means 56. In case that a reset signal is transmitted from the first CPU 41 to a reset terminal of the second CPU 55 in accordance with opening of the cover 9, the second CPU 55 sets various initial data in the second RAM 59 to initialize to the same state as that of power-on. The second CPU 55 is connected to a sheet feed drive circuit 65. The feed drive circuit 65 drives the feed motor 17 responsive to a signal which the second CPU 55 outputs to the circuit 65 based on the feed data inputted from the first CPU 41. The sheet 19 is fed by the rotation of the feed motor 17. The second CPU 55 is further connected to a carriage drive circuit 67. The carriage drive circuit 67 drives the carriage drive motor 25 responsive to a signal generated by the second CPU 55 based on the type data inputted from the first CPU 41. Thus the printing mechanism 7 is successively shifted along a printing line.

The first CPU 41 is connected to the third CPU 69 to which a third ROM 71 and a third RAM 73 are respectively connected. The third ROM 71 comprises a program data region 74 and a type data region 75. In the program data region 74, program data for executing various routines such as type selection or hammer driving are previously stored. In the type data region 75, type select data for setting one of types 31*a* of the type wheel 31 at the typing position by driving the type select motor 29 responsive to the inputted printing data and impact force data of each of the types 31*a* varying with its type face area for the print hammer 33 are stored. In the third RAM 73, the type select data or the impact data are stored, which are read from the type data region 75 responsive to the printing data outputted from the CPU 41. The third CPU 69 is connected to a type select drive circuit 77. The type select drive circuit 77 drives the type select motor 29 by a predetermined step number based on the type select data read from the type data region 75 to set the corresponding type 31*a* at the printing position. The third CPU 69 is also connected to a ribbon lift drive circuit 79 for driving the ribbon lift motor 30 so that the type ribbon is moved up to the printing position. The third CPU 69 is further connected to a ribbon feed drive circuit 81 for driving the ribbon feed motor 32 by a predetermined distance in printing direction every time after a type 31*a* is struck. The third CPU 69 is connected to a print hammer drive circuit 83 for driving the print hammer 33 based on the impact force data read from the type data region 75 to hit the type 31*a*, set at the printing position, by each preset impact force via the ribbon against the sheet.

The usual operation of feeding, i.e., when the cover 9 is not moved, will be described with reference to FIG. 5.

Figure 5:
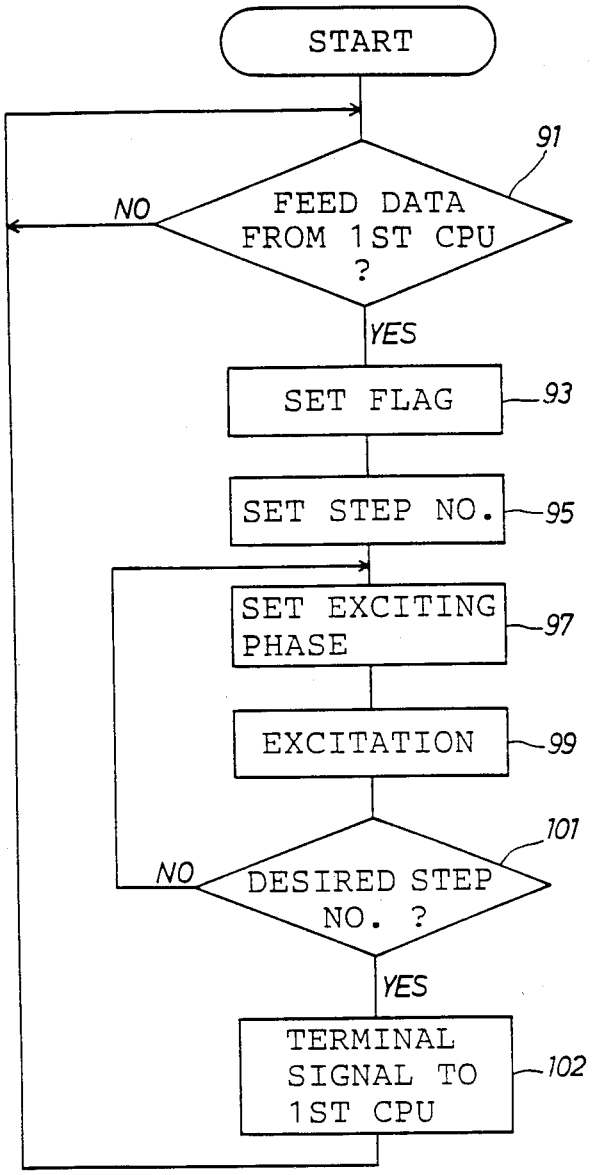
FIG. 5 is a flowchart showing conventional sheet feeding routine by the second CPU 55.

In FIG. 5 showing the processing flow of the second CPU 55 in feeding, the second CPU 55 determines whether the feed data from the first CPU 41 is inputted in step 91. In case the feed data from the first CPU 41 is not inputted, the second CPU 55 waits until it is inputted. In case that the feed data is inputted, i.e., the determination result is YES in step 91, the rotational direction of the feed motor 17 is set at, or stored in, the flag 62 based on the feed data. The step number needed for rotating the feed motor 17 is set in the step counter region 64 based on the feed data in the step 95. The second CPU 55 sets the subsequent exciting phase of the feed motor 17 in the exciting phase counter region 61 in the step 97. Then, the exciting phase of the feed motor 17 stored in the exciting phase counter region 61 is excited to drive the feed motor 17 by one step in step 99. The second CPU 55 decrements the step number stored in the step counter region 64 by one. In step 101, it is determined whether the step number stored in the step counter region 64 is "0", i.e., whether the feed motor 17 is driven by the predetermined step number responsive to the feed data. In case that the determination result is NO, the routine returns to step 97. In case that the determination result is YES, indicating that the feed motor 17 is driven by predetermined step number so that a target line of the sheet 19 is set at the position of the printing mechanism 7, a drive completion signal is outputted to the first CPU 41 in step 102 and the routine returns to step 91.

The first CPU 41 outputs a new feed data to the second CPU 55 at a time when it receives the drive completion signal.

Figure 6:
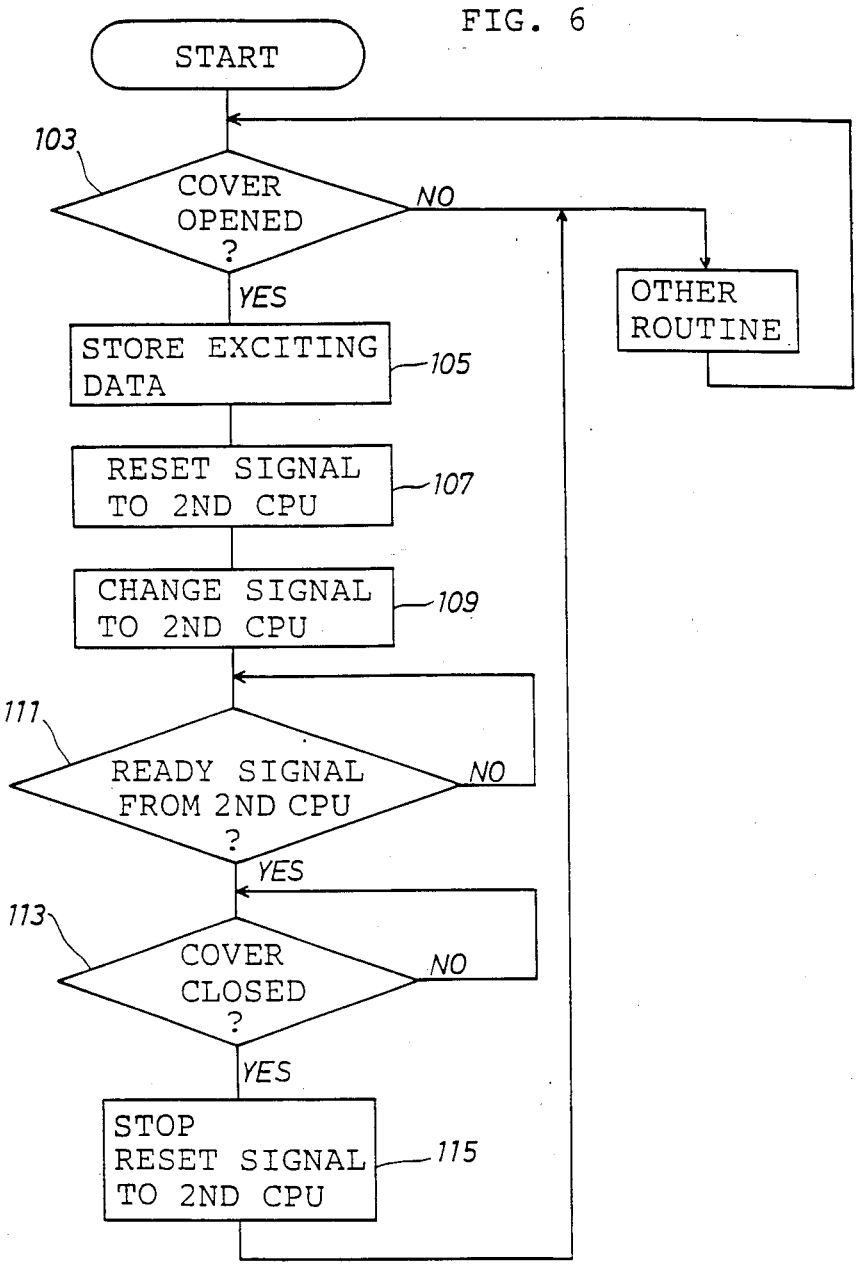
FIG. 6 is a flowchart showing a routine of the first CPU 41 for executing sheet feeding in accordance with opening and closing of the cover.
Figure 7:
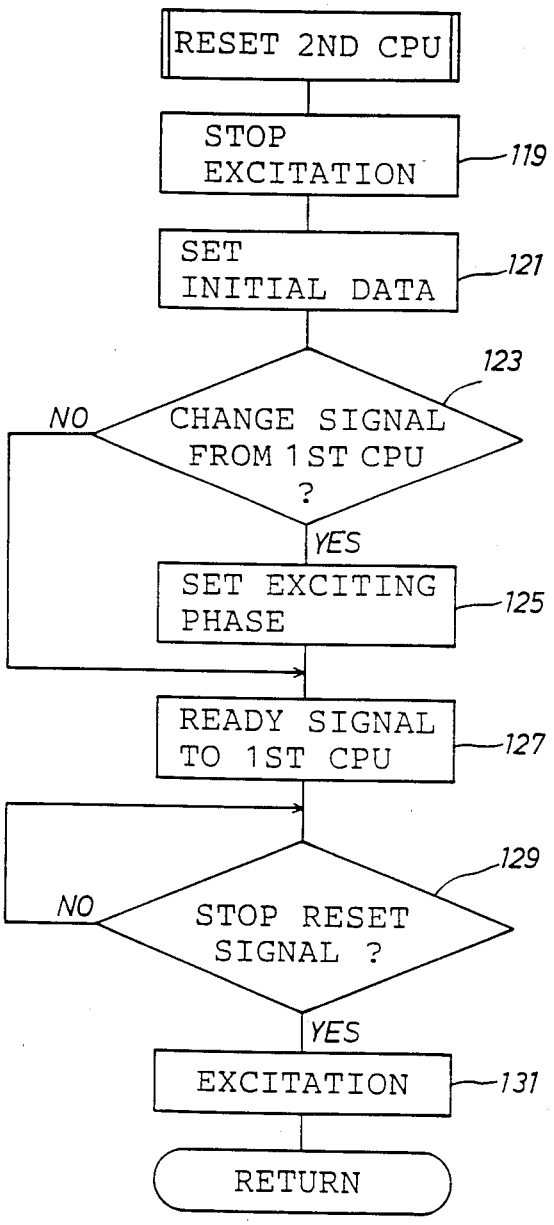
FIG. 7 is a flowchart showing a routine of sheet feeding after the second CPU 55 is reset.

Routines of the sheet feeding when the cover 9 is operated is described in reference to FIGS. 6 and 7.

FIG. 6 shows a routine of the first CPU 41 for feeding sheets in case of operating the cover 9. The first CPU 41 determines whether the microswitch 11 generates an OFF signal in the step 103 in response to opening of the cover 9 to request an interrupt to the first CPU 41. In case that the cover is not opened, no interrupt is requested and another routine such as key scan is executed. When the interrupt is requested, the first CPU 41 receives the exciting phase data of the feed motor 17 of just before opening of the cover 9, stored in the exciting phase counter region 61, from the second CPU 55, and stores the data in the exciting phase memory region 51 in step 105. The routine proceeds to step 107 where the first CPU 41 outputs a reset signal to the second CPU 55 so that the second CPU 55 is initialized to a power-on state. By this, various initial data such as the initial exciting phase data of the respective motor is set in the second RAM 59. The initial exciting phase data is constant irrespective of the exciting phase before opening of the cover 9. Immediately after the reset signal is outputted, the routine proceeds to step 109 where the first CPU 41 outputs a change signal to the second CPU 55 to change the first exciting phase of the feed motor after closing the cover 9 to the one just before opening. The change signal is generated based on the exciting phase data in the exciting memory region 51. In step 111, it is determined whether a READY signal is inputted from the second CPU 55, i.e. whether the second CPU has set the feed motor 17 to be ready for excitation from the exciting phase of just before opening of the cover 9. In case that the determination result is NO, the first CPU 41 waits until the READY signal is inputted. In case of YES, i.e., the READY signal is inputted, the first CPU 41 determines whether the cover 9 is closed based on the signal from the microswitch 11 in step 113. In case that the determination result is NO, the first CPU 41 waits until the cover 9 is closed. In case of YES with an ON signal from the microswitch 11, the first CPU 41 stops outputting the reset signal to the second CPU 55 in step 115, and returns from the interrupt routine to another routine such as key scanning.

Referring to FIG. 7 showing a flow of a routine for feeding a sheet at a time when the second CPU 55 is reset, when the second CPU 55 receives the reset signal from the first CPU 41 in the step 107, the second CPU 55 stops excitation of the feed motor 17 in step 119. The routine proceeds to step 121 where the respective initial data corresponding to each region of the second RAM 59 are set. For example, the initial exciting phase data of the feed motor 17 is set in the exciting phase counter region 61. The routine proceeds to step 123 where the second CPU 55 determines whether the change signal for changing the first exciting phase of the feed motor 17 after closing the cover 9 to the one just before opening of the cover 9 is inputted from the first CPU 41. In case the second CPU 55 is reset by opening of the cover 9, the change signal is transmitted from the first CPU 41 to the second CPU 55, making the determination result of step 123 YES. In step 125, the second CPU 55 stores the exciting phase data transmitted from the exciting phase memory region 51 in the exciting counter region 61. The routine proceeds to step 127 where the READY signal is outputted to the first CPU 41. When the second CPU 55 is reset by a power-on, the change signal is not inputted from the first CPU 41. So the routine proceeds directly to step 127 because the determination result in the above step 123 is NO. The routine proceeds to step 129, where the second CPU 55 determines whether the reset signal from the first CPU 41 is stopped in accordance with closing the cover 9. In case that the determination result is NO, the second CPU 55 waits until the reset signal is stopped. In case the reset signal from the first CPU 41 is stopped in accordance with closing the cover 9, the determination result being YES in step 129, the second CPU 55 excites the exciting phase of the feed motor 17 from that of just before closing the cover 9 set in the exciting phase counter region 61 in step 131. The second CPU 55 then returns to the normal routine for processing the normal feeding of the sheet 19 controlled in accordance with the flowchart of FIG. 5.

Thus, even when the second CPU 55 which executes drive control for both the feed motor 17 and the carriage drive motor 25 is reset responsive to opening of the cover 9, the present embodiment prevents the sheet 19 from moving its position by exciting the feed motor 17 from the exciting phase just before opening of the cover 9. The present invention can be embodied with an alteration as shown in FIGS. 8 and 9.

Figure 8:
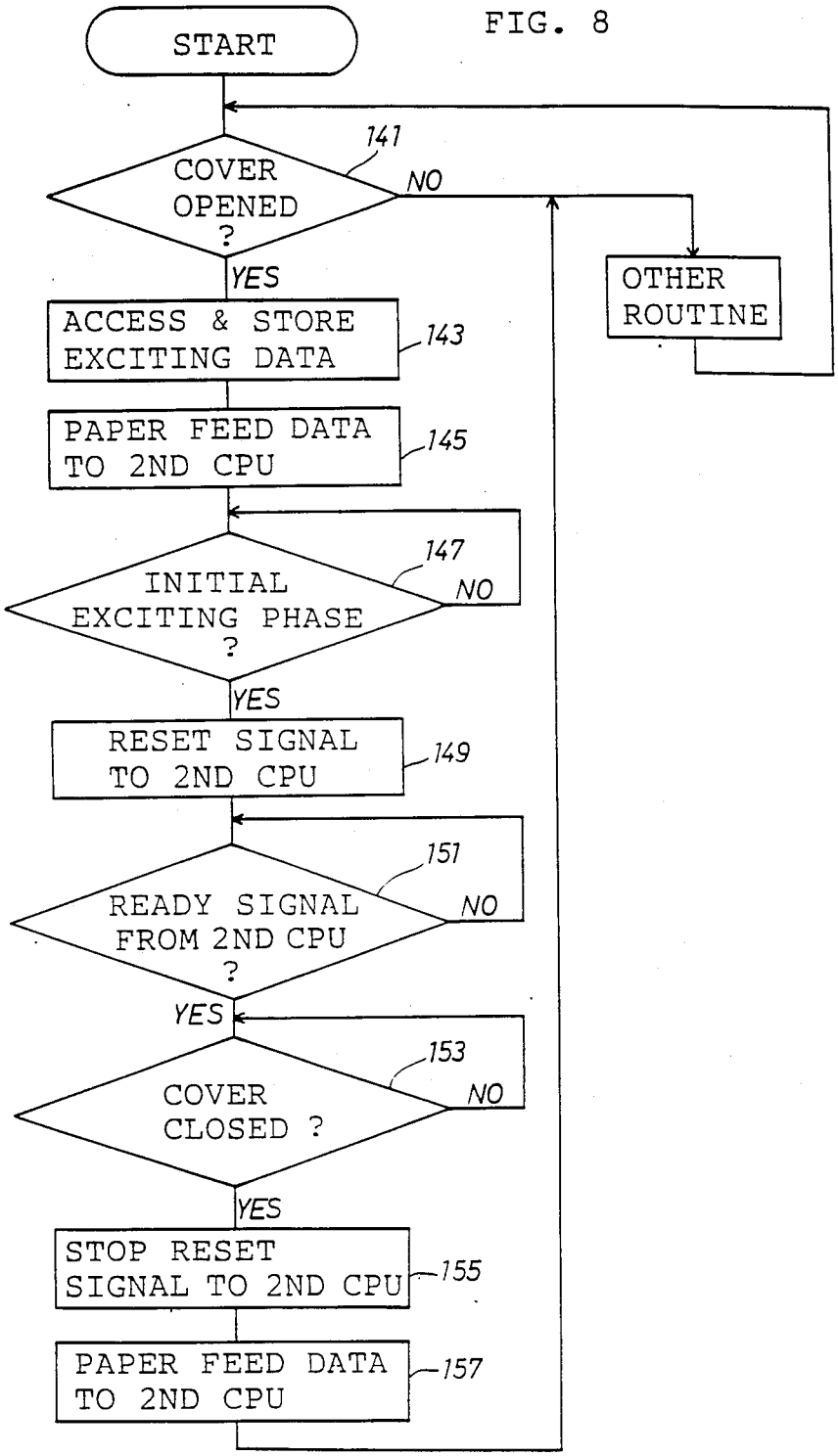
FIGS. 8 and 9 are flowcharts showing altered embodiments of the invention.

Referring to FIG. 8 showing a flow of a routine by the first CPU 41 when the cover is opened and closed, the first CPU 41 determines whether an OFF signal is inputted from the microswitch 11 in step 141. In case the cover 9 not opened, i.e., an OFF signal is not inputted, other normal routines are executed. In case that the cover 9 is opened and an interrupt is requested, the first CPU 41 receives the exciting phase data of the feed motor 17 just before opening of the cover 9 stored in the exciting phase counter region 61 and stores it in the exciting phase memory region 51. The routine proceeds to step 145 where the first CPU 41 outputs the feed data to the second CPU 55 for driving the feed motor 17 to the initial exciting phase. The routine proceeds to step 147 where it is determined whether or not the current exciting phase of the feed motor 17, which is known by the count number of the exciting phase counter region 61, is the initial exciting phase. This determination is done by judging whether or not a drive completion signal from the second CPU 55 is generated. In case that the determination result is NO, the first CPU 41 waits until the exciting phase becomes the initial exciting phase. In case that the determination result in step 147 is YES, i.e., the initial exciting phase of the feed motor 17 is the initial exciting phase, the first CPU 41 outputs the reset signal to the second CPU 55 to initialize it. The routing proceeds to step 151 where it is determined whether a READY signal, indicating that the second CPU 55 is initialized, is inputted from the second CPU 55. In case that the determination result is NO, the first CPU 41 waits until the READY signal is inputted. In case of YES, the first CPU 41 then determines whether the cover 9 is closed depending on the signal from the microswitch 11 in step 153. In case that the determination result NO, the first CPU 41 waits until the cover 9 is closed. In case of YES, i.e. the cover 9 is detected to be closed according to an ON signal from the microswitch 11, the routine proceeds to step 155 where the first CPU 41 stops outputting the reset signal to the second CPU 55. In step 157, the first CPU 41 generates feed data for driving the feed motor 17 from the initial exciting phase to the exciting phase of just before closing the cover based on the exciting phase data stored in the exciting phase memory region 51. Then the first CPU 41 returns from the interruption to execute normal routines.

Figure 9:
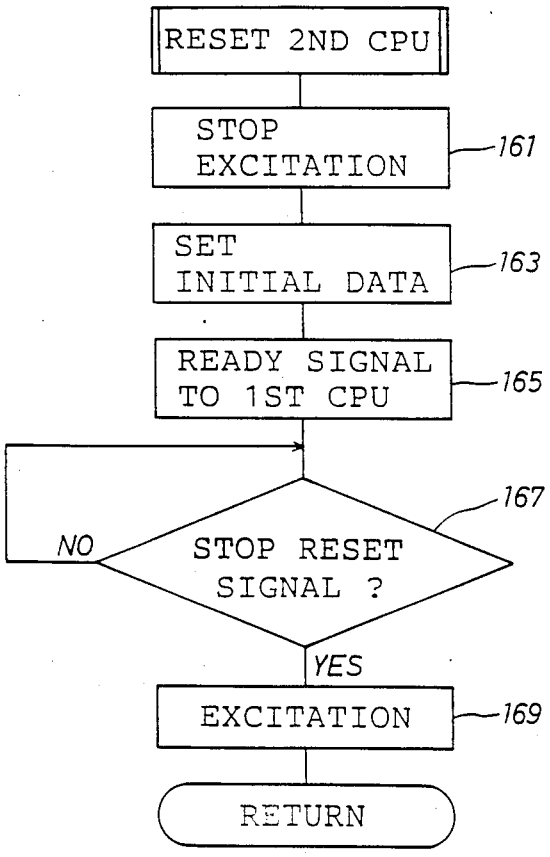

Referring to FIG. 9 showing processing flow of a routine of the second CPU 55 with respect to feeding in accordance with closing and opening of the cover 9, when the first CPU 41 generates the reset signal in step 149, the second CPU 55 stops excitation of the feed motor 17 in step 161. Then it proceeds to step 163 where, based on the program data stored in the second ROM 57, corresponding initial data are set in the respective region of the second RAM 59, making the second CPU 55 initialized to a power-on state. Then it proceeds to step 167 where it is determined whether the reset signal from the first CPU 41 is stopped. In case that the determination result is NO, the second CPU 55 waits until the set signal is stopped. In case of YES in step 167, i.e., the reset signal from the CPU 41 is stopped, the second CPU 55 excites the initial exciting phase of the feed motor 17 in step 169 and then returns to normal operations of sheet feeding as shown in FIG. 5. This embodiment prevents the sheet 19 from moving its position before and after opening of the cover 9 as well as aforementioned one.

Figure 4C:
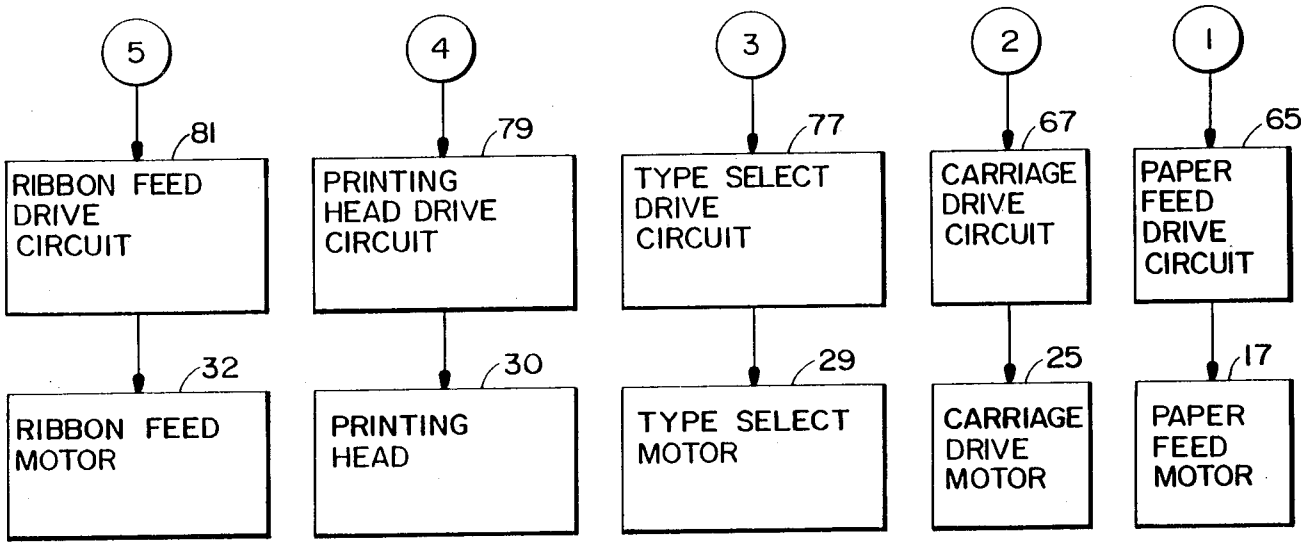

The above descriptions are explained with reference to an electronic type writer 1 in which the sheet 19 is need to be frequently placed to the printing position before the printing mechanism 7. However, as shown in FIG. 4c it can be embodied in a dot-wire impact type, a thermal ink-transfer type, an ink jet type, an impact type or any other printing devices, having a drive circuit and a printing head in which a single ECU controls both a sheet feed motor and at least one of the printing mechanism motors and is initialized when the cover is opened.

What is claimed is:

1. A printing device for printing on a sheet, including:
- a sheet feed means including a feed motor;
- a movable cover for covering a printing mechanism;
- a detector for detecting an opening and a closing of the cover;
- a memory means for storing a last exciting phase of the feed motor at a time when the opening of the cover is detected by the detector; and
- a feed control means for setting the feed motor at the last exciting phase when the closing of the cover is detected by the detector.

2. The printing device as claimed in claim 1, wherein;
- the printing device further includes a printing motor for operating the printing mechanism and
- the feed control means comprises:
- a processing unit for determining an exciting phase of the feed motor and the printing motor and for outputting an exciting phase signal thereto and;
- an initial setting means for setting the processing unit in the same state as a power-on initialized state when the opening of the cover is detected by the detector.

3. The printing device as claimed in claim 2, wherein the processing unit outputs a predetermined initial exciting phase signal to the feed motor and another predetermined initial exciting phase signal to the printing motor while in the power-on initialized state.

4. The printing device as claimed in claim 3, wherein the last exciting phase of the feed motor stored in the memory means is represented by an exciting phase signal outputted from the processing unit to the feed motor when the opening of the cover is detected.

5. The printing device as claimed in claim 3, wherein the initial setting means is constructed as a host processing unit and the processing unit is constructed as a slave processing unit in the printing device.

6. The printing device as claimed in claim 5, further comprising:
- a second memory in the slave processing unit for storing a current exciting phase of the feed motor, wherein the feed motor is controlled in accordance with the current exciting phase;
- means responsive to the opening of the cover for sending a last exciting phase, which is the current exciting phase of the feed motor stored in the second memory, to the memory means;
- means for setting the slave processing unit to the power-on initialized state, whereby the predetermined exciting phase is stored in the second memory of the slave processing unit;

means for sending the last exciting phase from the memory means to the second memory of the slave processing unit; and means responsive to the closing of the cover for starting control of the feed motor from the last exciting phase stored in the second memory.

7. The printing device as claimed in claim 5, further comprising:

a second memory in the slave processing unit for storing a current exciting phase of the feed motor whereby the feed motor is controlled in accordance with the current exciting phase;

means responsive to the opening of the cover for storing in said memory means a last exciting phase the last exciting phase being the current exciting phase of the feed motor stored in the second memory;

means for storing in an entry of the second memory the predetermined exciting phase, and for driving the feed motor in a first direction responsive to the predetermined exciting phase;

means for setting the slave processing unit to the power-on initialized state after the feed motor is driven responsive to the predetermined exciting phase; and means responsive to the closing of the cover for rewriting said entry of the second memory from the predetermined exciting phase to the last exciting phase stored in the memory means, and for driving the feed motor responsive to the last exciting phase in a second direction which is opposite said first direction.

8. The printing device as claimed in claim 5, wherein the printing mechanism includes a type wheel that is rotated by a motor to select a desired type.

9. The printing device as claimed in claim 5, wherein the printing mechanism includes a carriage that is driven by said printing motor to move along a printing line.

10. The printing device as claimed in claim 9, wherein the printing device includes a printing mechanism including an impact-dot-wire printing head.

11. The printing device as claimed in claim 9, wherein the printing device includes a printing mechanism including an ink jet printing head.

12. The printing device as claimed in claim 9, wherein the printing device includes a printing mechanism including a thermal printing head.

* * * * *